US005751660A

United States Patent [19]

Chappell

[11] Patent Number: 5,751,660

[45] Date of Patent: May 12, 1998

[54] CONTAINER FOR MEDICATION

[76] Inventor: Martin N. Chappell, 1000 S. Main St., Suite 632, Salinas, Calif. 93901

[21] Appl. No.: 592,758

[22] Filed: Jan. 26, 1996

[51] Int. Cl.[6] ..... G04B 47/00

[52] U.S. Cl. ..... 368/10

[58] Field of Search ..... 368/10; 215/1, 215/230, 256; 221/3

[56] References Cited

U.S. PATENT DOCUMENTS

| | | | |
|---|---|---|---|
| 2,538,684 | 1/1951 | Gushard et al. | 215/1 |
| 4,419,016 | 12/1983 | Zoltan | 368/10 |
| 4,586,622 | 5/1986 | Waldorf | 215/256 |
| 4,939,705 | 7/1990 | Hamilton et al. | 368/10 |
| 4,986,429 | 1/1991 | Singleton, Jr. | 215/230 |
| 5,170,380 | 12/1992 | Howard et al. | 368/10 |
| 5,201,431 | 4/1993 | Berger et al. | 368/278 |
| 5,332,112 | 7/1994 | Blocker | 215/230 |
| 5,433,324 | 7/1995 | Leonard | 206/534 |
| 5,495,961 | 3/1996 | Maestre | 221/3 |

*Primary Examiner*—Bernard Roskoski
*Attorney, Agent, or Firm*—Thomas Schneck

[57] ABSTRACT

A container for drugs which features a cylindrical vial with a radially outwardly flared skirt or axial bulge which symbolically designates the vial as one containing medication requiring special attention. The container may be formed as one or two pieces but in either case there is a portion below the internal bottom wall of the vial which can house a timer unit with a time display. A switch sets a time which remains on display, indicating the last time the switch was actuated, i.e. the last time medication was taken. The timer is mounted in a way so that it may be retained, even though the vial is discarded.

12 Claims, 4 Drawing Sheets

CONTAINER FOR MEDICATION

TECHNICAL FIELD

The invention relates to containers for drugs and more particularly to containers for medication which is subject to a strict compliance regimen.

BACKGROUND ART

There are many drugs sold today which contain ingredients which are toxins if taken in large doses. Such drugs are commonly used in coronary care and chemotherapy, as well as the treatment of AIDS and other illnesses. In most instances warning labels are placed on the bottles by pharmacists and patients are instructed to carefully monitor dosages. However, with the increase in mail order delivery of prescriptions there is a need to heighten a patient's awareness that certain medications must be carefully administered.

Many patients often take a large number of medications, often prescribed for different intervals. Some of these medications are of little consequence if taken too frequently, but others can be dangerous. Patients can easily become confused regarding whether any particular medication has been taken and whether the doubtful medication is one that can be harmful.

Sometimes aged patients have trouble reading or understanding labels and so are not aware of any particular danger with a drug. This is often true of patients having the greatest need for strong medication.

Another problem is that many patients have difficulty is remembering the time of their last dose. Bottles are clearly labeled with dosages but frequently a wrong dosage occurs because a patient cannot remember whether a medication has been taken, often because the task is performed mechanically and does not register in the patient's awareness.

In U.S. Pat. No. 5,170,380 Howard et al. disclose a holding device for medication containers which provide a patient with the last time the medicine was taken by actuating a timer with a switch. The medication container is nested in a holder which sits in a base having timing circuits.

U.S. Pat. Nos. 4,419,016 and 4,939,705 both disclose pill bottles having closures which incorporate timing devices which remind the patient of the time for a dose. There are many other patents which deal with the same problem, many with sophisticated electronics which alert a user to the next time a dosage is to be taken.

My concern has been primarily with the risk associated with toxic doses, not with providing reminders of the next dose. Of course timing considerations enter into the risk analysis because a patient not aware of his last dose can consume an overdose of a toxic drug. An object of the invention has been to provide a medication container which warns of toxic drugs and which indicates the time of the last dose.

SUMMARY OF INVENTION

The above object has been achieved in a medication container, comparable in size and weight to conventional pill bottles, but having a shape which is optically distinctive and distinctive to the sense of touch. The distinctiveness is achieved by providing a symmetric bulge in the container, preferably a flared skirt, particularly in the base region, serving as a symbol for a strict compliance medication. The bulge or flared region may optionally be used to house a timer which displays the last time medication was taken. Such a bulge indicates a potentially harmful drug where special care is needed. The bulge is intended to signify a warning and so the container itself becomes a symbol for the compliance program.

The vial or container uses existing size caps and may be made with existing molding equipment modified for producing the shape described herein, including a dimple in the top of the cap which seats a label which may be used to display dosing indicia. Conventional materials may also be used. The vial, exclusive of the timer, is disposable, thereby reducing pill dust and miscellaneous particulate debris.

BEST MODE FOR CARRYING OUT THE INVENTION

Figure 1:
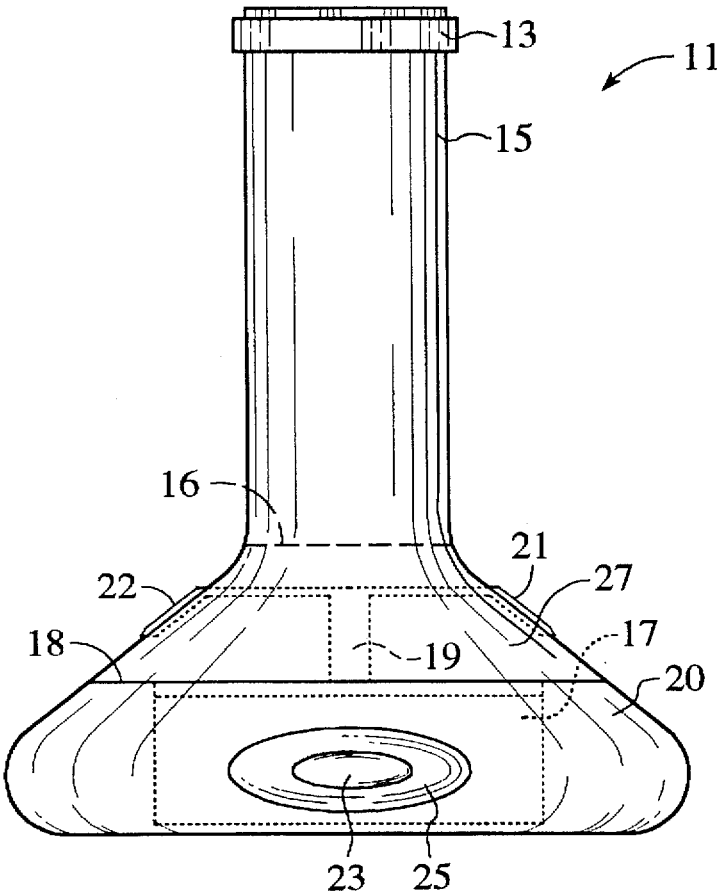
FIG. 1 is a front elevational view of the container for medication in accord with the present invention.
Figure 1A:
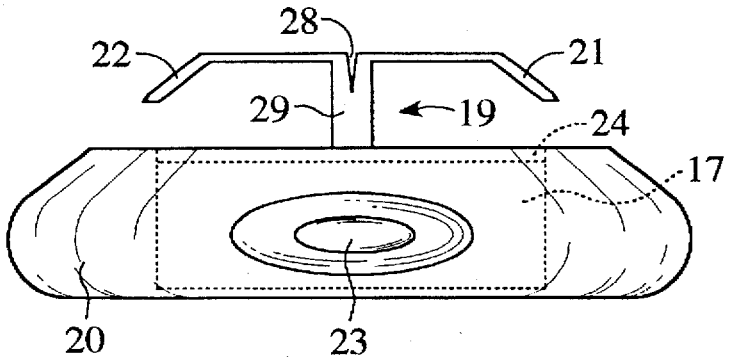
FIG. 1A is a view of the lower portion of the container of FIG. 1.
Figure 2:
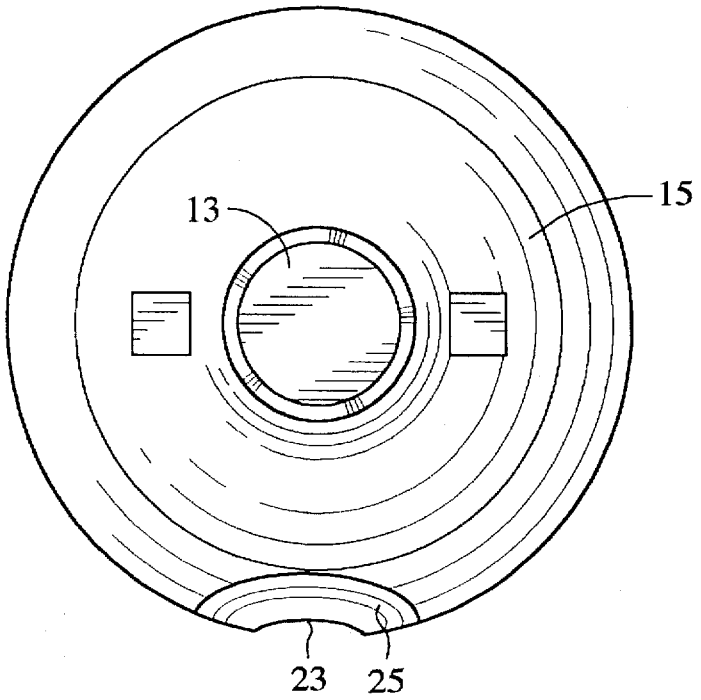
FIG. 2 is a top view of the container for medication shown in FIG. 1.

With reference to FIGS. 1, 1*a* and 2, container 11 is a container for drugs in accord with the present invention. The container features a cylindrical vial 15 having a cap 13 and a solid bottom wall 16 which defines the lower storage volume of the hollow cylindrical vial 15. The size of the storage volume is comparable to common pill bottles. Below the bottom wall 16 is a lower detachable unit 20 which is joined to the vial 15, which forms an upper unit, at the annular periphery 18 of the vial. The vial wall flares outwardly near bottom wall 16 toward annular periphery 18, forming a skirt. Both upper and lower units are radially symmetric about the cylindrical axis of the vial. The extent of the outward flare is preferably between 0.5 to 3 cylindrical radii measured from the cylindrical wall to the furthest outward extent of the bulge.

Extending into the hollow area of the skirt is a spacer unit 19 which includes a pair of wings 21 and 22 which lock into windows provided within the annular skirt above the periphery 18, but below bottom wall 16. The spacer 19 is mounted to timer unit 17 by screws. The lower detachable unit 20, less than half the height of the upper unit, is supported entirely by wings 21 and 22 fitting within windows in the skirt 27. A slot 28 in the top of shaft 29, seen in FIG. 1A, allows some compression of the wings 21 and 22 allowing them to move slightly closer together when one of the wings is pushed. This compression allows release of the lower detachable unit 20 from the skirt 27 associated with the cylindrical vial 15 so that the vial can be discarded and the timer saved.

The push button 23 is pushed to latch the current time maintained by timer unit 17. The timer unit is continuously running and internally maintains the current time. Optionally, the timer may be provided with a memory to store the latched times for later retrieval by a medical overseer. The timer unit has a digital watch movement, powered by a compact lithium battery, operating an LCD display. However, the only time which is displayed is the time latched or "stamped" as a reminder of the last dose taken when the push button 23 is depressed. Auditory feedback, such as a beep, can be provided by an oscillator and miniature speaker associated with the push button. Such circuits are common in alarm watches. In this manner, auditory feedback confirms that the push button has been pushed and the time latched and displayed.

The timer unit fits within the lower detachable unit 20 allowing the detachable unit to extend the skirt 27 downwardly so that the cylindrical vial displays a distinctive shape indicative of a special type of medication, such as a toxic or an especially potent medication. The extent of the flare for the skirt portion is such that the vial, including the timer, maintains light weight, only a few ounces, yet is optically distinctive to a person's sight and perceptible to the touch. A person grasping the vial would immediately recognize that it is unusual in shape, even with the lower detachable unit 20 detached. It is recommended to use color coding of labels, or the button, and caps to distinguish different types of medication and to place a special label in a depressed region within cap 13, indicating the number of times per day the medication is to be taken.

The two-piece construction shown in FIG. 1 allows a user to retain the lower detachable unit 20, with a timer, and only purchase the cylindrical vials 15 as needed. The upper cylindrical vials 15 are disposable, but the lower detachable unit 20 is retained for reuse with other upper portions. The cylindrical vial 15, as well as the lower detachable unit 20 are made of polycarbonate which is optically clear, but usually dyed dark to filter light which might cause degradation of medications. Other plastic materials, particularly opaque materials, could be used.

Figure 3:
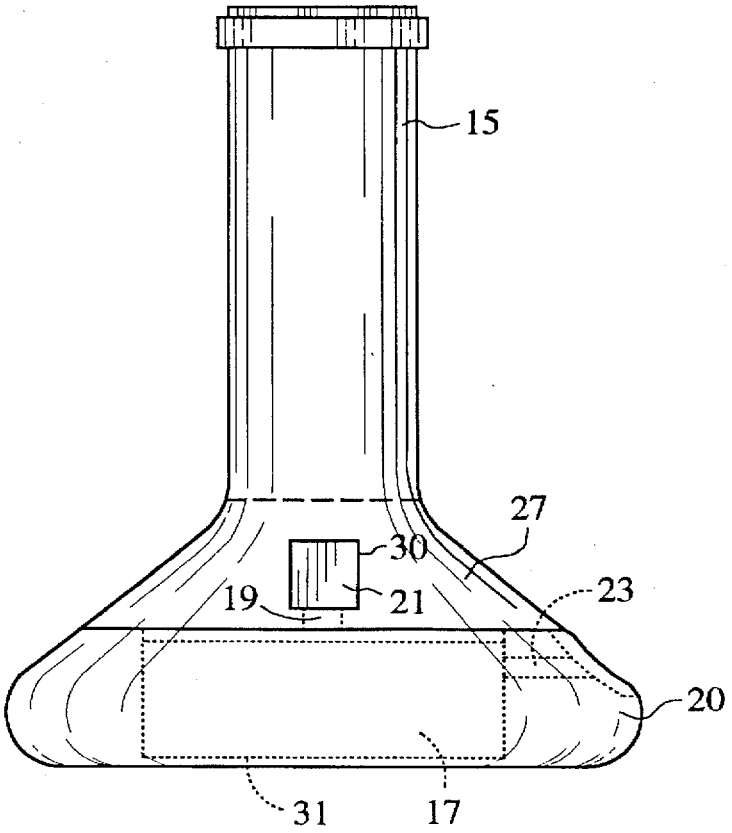
FIG. 3 is a side elevational view of the container for medication of FIG. 1.
Figure 4:
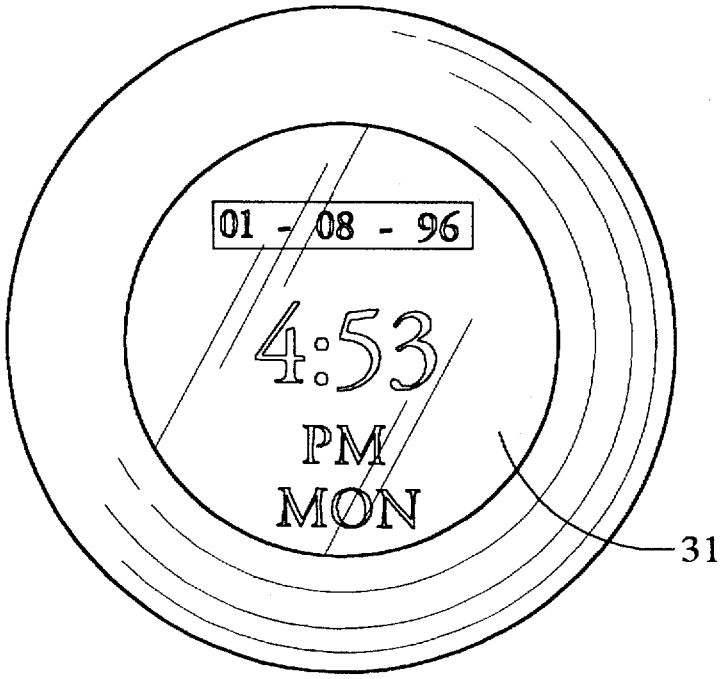
FIG. 4 is a bottom view of the container of FIG. 1.

In FIG. 3, window 30 in the side of skirt 27 is shown to seat wing 21 associated with spacer 19. The wing 21 is seen to have a rectangular surface tab which fits into the window 30, occupying the entirety of the window. In FIG. 1, it is seen that the tab of wing 21 protrudes slightly from skirt 27, although this is not necessary. The wings may be slightly indented or flush with the surface of the skirt. In FIG. 3, push button 23 is also seen to be part of the lower detachable unit 20. Push button 23 extends into timer unit 17 for the purpose of latching the current time in a display which is in the bottom wall 31 of the timer unit, seen more clearly in FIG. 4. The time display, facing away from bottom wall 16, allows a user to turn the bottle upside down to view the last time the push button 23 was depressed, presumably the last time that the medication container was opened. The time display could also be placed in a manner to be visible through skirt 27.

Figure 5:
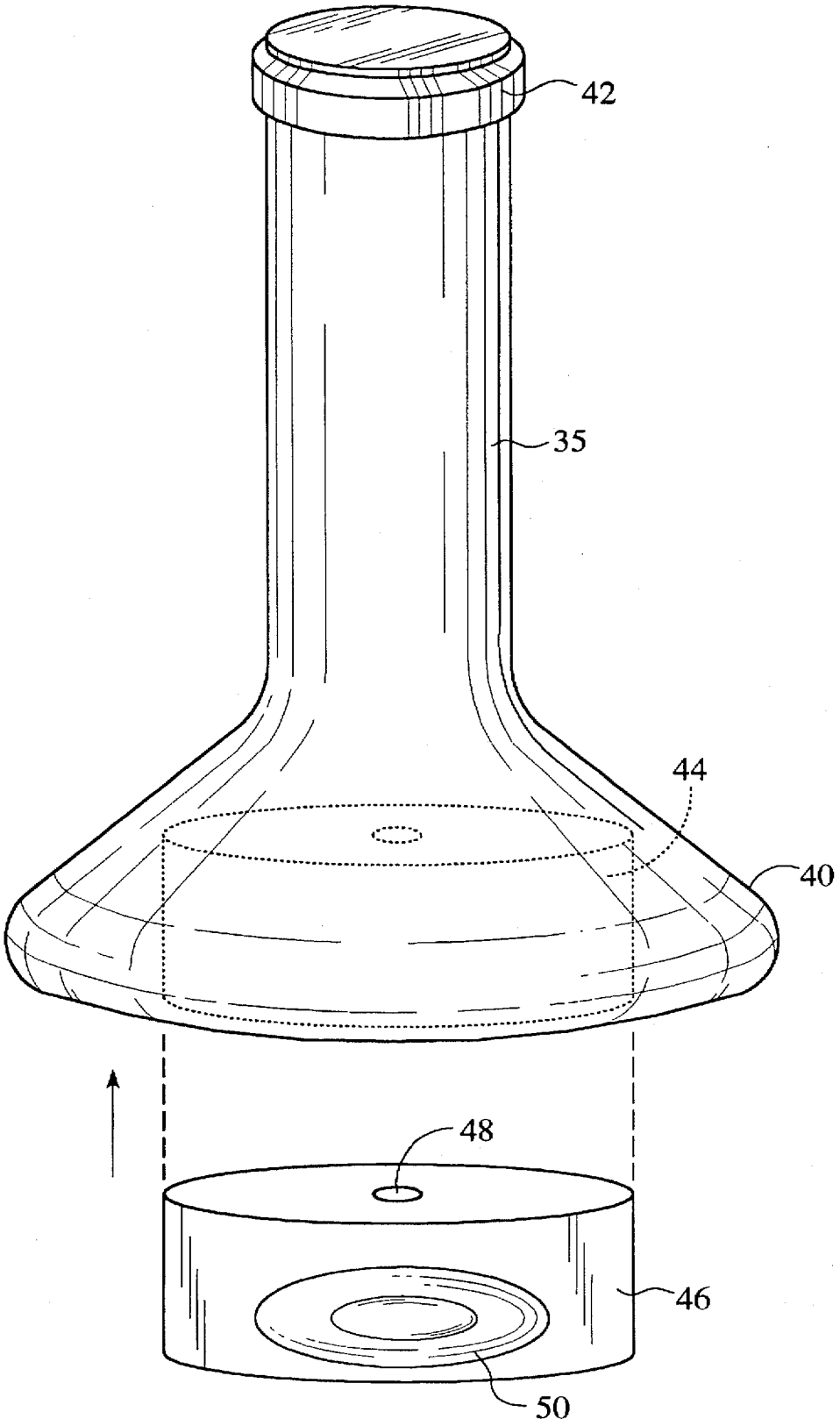
FIG. 5 is an assembly view of an alternate embodiment of the container for medication of FIG. 1.

FIG. 5 shows a cylindrical vial 35 which is a single piece of material, except for cap 42. The vial has an outwardly flared skirt portion 40 which defines a cavity 44 which is slightly larger than a timer unit 46 which is held in place by friction fit. The timer unit has a display 50 on the bottom of the unit so that the time display resembles the display shown in FIG. 4. The timer unit of FIG. 5 does not have a button which projects through the skirt but rather has a push button 48 in the top of the timer unit. To depress the push button, the entire timer unit is pressed against the back wall of cavity 44. This latches the time display and spring force restores the timer unit to a position slightly spaced from the back wall of the cavity so that the push button may be pressed again. Alternatively, an exterior button may be located in the skirt wall. The one-piece construction of FIG. 5 allows retention of the timer unit 46, while the entire container may be discarded.

The shape and extent of the outwardly flared skirt portion 40 is similar to that shown in FIG. 1. The skirt extends approximately 45 degrees from the vertical wall of the cylindrical vial 35.

I claim:

1. A finger held bottle for medication subject to strict compliance comprising, a cylindrical vial having a removable cap and a circumferential wall having an optically noticeable bulge in the wall, noticeable to a person's touch when the vial is held in the fingers, marking the vial as a container subject to a strict compliance regimen, said vial being formed of upper and lower portions, the upper portion including a closed bottom wall and the lower portion having a skirt flared outwardly in the vicinity of said bottom wall, a base unit attachable to the skirt in the lower portion of the vial by a spacer unit having a shaft that supports a pair of opposed wings which project into windows defined within said skirt, the shaft having a slot that allows compression of the wings, a time and date stamp timer mounted in the base of the vial, the timer always running but not displaying the current time and date, having a visible display and having a manually actuated switch for causing a time and date to be displayed on the display as a date and time stamp until the next time the switch is actuated.

2. The apparatus of claim 1 wherein the timer unit includes a display facing away from said bottom wall.

3. The apparatus of claim 1 wherein the timer unit includes a display readable through the skirt.

4. The apparatus of claim 1 wherein said cap has a shallow dimple for seating an information bearing wafer.

5. The apparatus of claim 1 wherein said distinctive bulge is in the base of the vial.

6. The apparatus of claim 5 wherein said distinctive bulge is a gradual outward taper extending from above the base of the vial and reaching a maximum circumference within a few millimeters of the base of the vial.

7. The apparatus of claim 1 wherein said cylindrical vial has an exterior wall defining a cylindrical plenum, said distinctive bulge being solid material.

8. The apparatus of claim 1 wherein said timer is removably mounted in the base of the vial.

9. The apparatus of claim 1 wherein said switch is actuated through an opening defined in the circumferential wall of the vial.

10. The apparatus of claim 1 wherein said switch is actuated by force transmitted through said base of the vial by downward pressure on the vial.

11. The apparatus of claim 1 wherein said vial and two separable sections, including an upper section and a lower section containing said timer.

12. The apparatus of claim 10 wherein said lower section has said bulge.

* * * * *